United States Patent [19]

Wehren

[11] 4,021,337

[45] May 3, 1977

[54] SIEVE WITH DRIVE

[75] Inventor: Peter Wehren, Bensberg-Refrath, Germany

[73] Assignee: Klockner-Humboldt-Deutz Aktiengesellschaft, Germany

[22] Filed: Sept. 2, 1975

[21] Appl. No.: 609,411

[30] Foreign Application Priority Data

Sept. 11, 1974 Germany ..... 2443370

[52] U.S. Cl. ..... 209/329; 209/367

[51] Int. Cl.[2] ..... B07B 1/34

[58] Field of Search ..... 209/329, 326, 325, 365 R, 209/365 A, 365 B, 365 C, 366.5, 367, 415; 74/61; 259/DIG. 42

[56] References Cited

UNITED STATES PATENTS

| | | | |
|---|---|---|---|
| 2,054,253 | 9/1936 | Norsch | 209/367 X |
| 2,061,943 | 11/1936 | Jurgensen | 259/DIG. 42 |
| 2,085,774 | 7/1937 | Symons | 74/61 X |
| 2,127,317 | 8/1938 | Welch | 74/61 |
| 2,325,248 | 7/1943 | Johnstone | 209/367 X |
| 2,776,751 | 1/1957 | Buck | 209/365 A |
| 2,901,111 | 8/1959 | Eppenberger | 209/326 X |
| 3,548,668 | 12/1970 | Amori | 209/344 X |
| 3,771,768 | 11/1973 | Gebendinger | 74/61 |

FOREIGN PATENTS OR APPLICATIONS

| | | | |
|---|---|---|---|
| 173,084 | 2/1935 | Switzerland | 209/365 A |
| 377,432 | 7/1932 | United Kingdom | 209/326 |
| 751,266 | 7/1956 | United Kingdom | 209/366.5 |
| 252,146 | 9/1969 | U.S.S.R. | 259/DIG. 42 |

*Primary Examiner*—Frank W. Lutter
*Assistant Examiner*—William A. Cuchlinshi, Jr.
*Attorney, Agent, or Firm*—Hill, Gross, Simpson, Van Santen, Steadman, Chiara & Simpson

[57] ABSTRACT

A sieve for screening material such as ore or coal wherein the sieve member extends horizontally and is supported at its edges by longitudinal sidewalls and at the center by a longitudinal intermediate wall and a vibratory oscillatory drive force is applied to the intermediate wall twice that of the sidewalls by rotating eccentric weights for the intermediate wall and sidewalls with the intermediate wall eccentric weight being twice that of the sidewalls eccentric weights and the rotating weights interconnected by flexible shaft drives and a main drive motor driving all of the weights in rotation.

11 Claims, 1 Drawing Figure

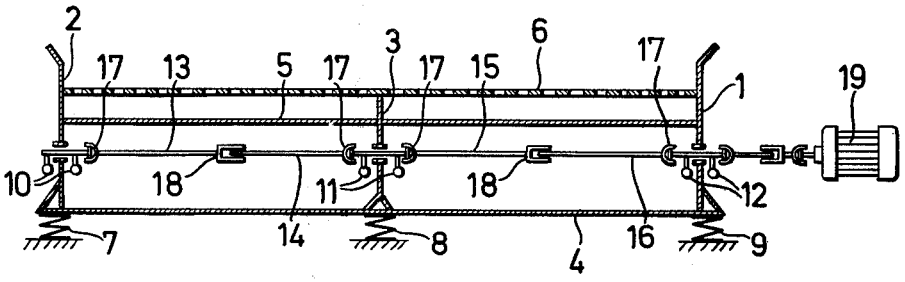
2
17
13
5
17
3
17
15
6
17
1
19
10
18
11
18
12
7
14
8
16
9
4

SIEVE WITH DRIVE

BACKGROUND OF THE INVENTION

The invention relates to improvements in vibratory or oscillating sieve screening devices for screening material such as ore or coal, and more particularly to an improved structure for more effectively and uniformly driving the sieve in oscillation.

Oscillating or shaking sieves are used in ore and coal preparation installations. For continuous effective operation, and in order to handle large volumes of ore and coal, it is necessary to continuously drive the screen or sieve structure in vibration or oscillation. One form of generating the oscillating drive force is by the rotation of eccentric or unbalanced weights wherein the force is by the rotation of the unbalanced weights is transmitted to the sieve surface. For satisfactory operation, it is desired that the vibratory forces are distributed as uniformly as possible over the entire sieve surface. This permits feeding the ore or coal uniformly to the surface, and results in uniform screening as the material passes over the surface. Unequal vibration results in unequal screening, and attempts to compensate for such unequal vibration are difficult because feeding the material to the screen normally is done at a uniform rate, and unequal screening is almost sure to occure if unequal vibration exists across the screen.

If the sieve construction is made narrow, it is more easy to rigidify the construction to obtain uniform vibration over the width of the screen surface. However, for production of coal and ore plants, it is commercially and economically necessary to provide relatively wide sieves which have a high through-put capacity. This in turn creates problems of obtaining rigidity of the sieve for purposes of attempting to obtain uniform vibration or oscillation across the entire width of the sieve surface.

It is accordingly an object of the invention to provide an improved construction for obtaining uniform oscillation or vibration across the width of a sieve surface making it possible to use relatively wide sieves and eliminating the necessity of very heavy constructions which are made heavy to rigidify the sieve to attempt to obtain the same vibration or oscillation in the center of the sieve as occurs at the edges. This objective is accomplished by an improved support and drive arrangement which obtains substantially uniform vibration across the width of the sieve. By eliminating heavy rigidifying constructions, the cost of sieve construction is reduced, and the input power needed for the vibratory drive can be relatively reduced.

It is accordingly a further object of the invention to provide an improved sieve construction, and method of driving a sieve in vibration which attains more uniform and more effective vibration and oscillation without increasing the input vibrational driving power needed.

A further object of the invention is to improve the uniformity of screened product obtained in a coal or ore separation sieve by providing an improved drive mechanism which makes the vibration of the sieve more uniform across its width.

In accordance with the principles of the invention, the vibratory drive for the sieve includes driving the sieve from its edges in vibration and also driving it intermediate the edges with the drive forces intermediate the edges being greater than at the edges and preferably twice the forces are applied at the intermediate point in the sieves as that at the edges. The sieve member is supported by longitudinal sidewalls and by an intermediate longitudinal wall. Conveniently, the drive forces are preferably applied by oscillatory rotational eccentric unbalanced masses with the masses for the drive for the sidewalls of a given weight and the masses for the intermediate walls being substantially twice that of the sidewalls. With this arrangement, a division of several excitation zones is attained, so that over its entire surface a strong oscillation excitation is obtained wherein all of the excitation force is utilized, but by this application of forces, uniform vibration of the sieve across its width has been the unexpected result.

Other objects, advantages and features of the invention will become more apparent with the description of the preferred embodiment, as will equivalent methods and structures which are intended to be covered herein, with the preferred embodiment containing the teachings of the principles of the invention, as described and shown in the following specification and drawings, in which:

DESCRIPTION OF THE DRAWINGS

The single drawing is a vertical sectional view, shown in somewhat schematic form, of a sieve and drive constructed and operating in accordance with the principles of the present invention.

DESCRIPTION

As shown on the drawing, the construction includes a horizontally extending screen or sieve member 6 having openings therein of the size desired for the separation of material such as coal or ore. The sieve 6 will extend horizontally or substantially horizontally with means provided, not shown, to feed a continuous supply of coal or ore onto the upper surface of the sieve. As the material is separated by vibration of the sieve, means are also provided for removal of the sieved or separated portions, and for removal or receiving the portions of material which stay on top of the sieve. The mechanism for feeding the material onto the sieve and removal thereof may be of various types which will be known to those versed in the art, and normally the material will proceed in a conveying direction across the surface of the sieve in a longitudinal direction due to the vibration of the sieve or due to an inclination of the horizontal surface thereof.

The sieve 6 is supported, and driven in vibration, at its sides by longitudinal sidewalls 1 and 2. These sidewalls extend slightly above the sieve to retain the material thereon at the sides. The sidewalls are connected to each other by a transverse plate-like support 5, which normally receives the sieved material. The sidewalls 1 and 2 are also interconnected by a lower frame plate 4. The vibratory or oscillatory sieve assembly is carried at the base plate 4 by a resilient foundation support such as springs 7, 8 and 9 which are rigidly mounted at their lower ends on a base or foundation.

For driving the sieve 6 in oscillatory vibration, drive means are connected to each of the sidewalls 1 and 2 shown preferably in the form of unbalanced oscillatory weights 10 and 12, which have substantially the same mass and substantially the same eccentricity with respect to their supporting center shafts which are rotationally mounted in the walls 1 and 2 by suitable bearing means. So as to synchronize the rotation of the unbalanced weights 10 and 12, to drive them simultaneously, they are interconnected by flexible shaft means, and a drive motor 19 is connected to drive the entire vibratory system, being preferably connected through a flexible coupling to the unbalanced weight 12 mounted on the longitudinal sidewall 1.

With the screen 6 vibrational drive forces are supplied at the edges due to the longitudinal walls 1 and 2, and it has been found that the vibration of the screen will be unequal across its width with the mere application of side forces. The present arrangement applies a force intermediate the edges of the screen, preferably on the order of twice the oscillating force applied at the side edges of the screening area of the sieve 6. This is accomplished by an intermediate wall 3 being in supporting driving connection with the sieve 6, with the intermediate wall preferably halfway between the two sidewalls 1 and 2. The sidewalls 1 and 2 extend longitudinally parallely along the side of the screen, and the intermediate wall 3 also extends longitudinally parallel to the sidewalls and is connected at its upper edge to the sieve and its lower edge to the lower plate 4, and intermediate, to the plate 5 so that it forms part of the unit. Drivingly mounted in the intermediate wall is a force applying means in the form of an eccentric unbalanced rotational weight 11 mounted on a shaft suitably carried in bearing in the intermediate wall 3. The unbalanced weights 11 are twice as heavy as the weights 10 and 12 for the longitudinal sidewalls. The vibratory force applied to the intermediate wall 3 is applied in synchronism with the forces at the sidewalls, and for simplicity of driving arrangement, the interconnecting shaft system is so constructed so that the shafts of the unbalanced weights are in substantially axial alignment, and driving shaft interconnect the shafts of the outer weights directly with the shaft of the intermediate weight.

Thus, the motor 19 drives the weights 12 in rotation, and a shaft 16 connects through a flexible joint 18 to a shaft 15 connected to the intermediate weight 11. Similarly, a shaft 14 connects through a flexible connection 18 to a shaft 13 connecting to the eccentric weight 10. Flexible couplings 17 connect the shafts 14 and 13 to the intermediate weights 11 and outer weights 10 respectively. Similar flexible couplings also numbered 17 connect the shafts 15 and 16 to the intermediate weights 11 and the weights 12.

The flexible couplings 18, which are located intermediate each of the shafts connecting the outer wall drives to the intermediate wall drive, are of the axial recess and insert type which affords them axial elasticity. These are cardanic joints which permit variation in the length of the shafts 15 and 16 and of the shafts 14 and 13 respectively.

It is contemplated that instead of a single intermediate wall 3, a plurality of intermediate longitudinal walls may be arranged, each with their own drive force mechanisms. The forces applied to each of the intermediate walls are greater than to the outer walls, and preferably twice the force applied to the outer wall. Preferably, the intermediate walls would be uniformly spaced from each other and from the outer wall. This arrangement effectively divides the sieve surface into individual excitation zones which mutually complement adjacent zones and result in a uniform screening of the material on the upper sieve surface. Vibratory sieves of this construction may be operated and installed having a width of up to approximately 6 m. For greater sieving areas, it is possible to connect a plurality of similarly constructed sieves in parallel, beside each other and couple the parallel sieve assemblies to each other to be driven by a single operating force. With this construction, a preferred arrangement is to provide in the case of parallel side-by-side units to position the unbalanced weights offset with one another, preferably 180°, so that the moments of unbalances of the sieves are mutually cancelled.

I claim as my invention:

1. In a vibratory sieve construction, the combination comprising:

a substantially horizontal sieve member for receiving material on its upper surface to be screened;

first and second longitudinal sidewalls extending along the sieve member located adjacent the sides of an area of the sieve member with the walls in vibration transmitting support relative to the sieve member;

an intermediate longitudinal wall between said sidewalls in vibration transmitting support relation to the sieve member;

first and second vibratory drives connected to the sidewalls having a vibratory force output for applying said force to the sidewalls;

an intermediate vibratory drive connected to the intermediate wall having a vibratory force output substantially twice the force output of each of said first and second drives;

means for interconnecting said first and second drives with said intermediate drive for direct operation in synchronism;

and motor means for applying an operating force to said drives.

2. In a vibratory sieve construction in accordance with claim 1:

said first and second vibratory drives being rotational with eccentric weights being mounted respectively on the first and second sidewalls;

and said intermediate vibratory drive being rotational and being mounted on the intermediate wall with eccentric weights being substantially twice the weights of said first and second drives.

3. In a vibratory sieve construction in accordance with claim 2:

including rotational shafts interconnecting each of said rotational drives.

4. In a vibratory sieve construction in accordance with claim 3:

wherein said motor means is connected to the drive on one of said sidewalls.

5. In a vibratory sieve construction in accordance with claim 3:

including a universal drive connection in each of the shafts between said sidewall drives and said intermediate wall drives permitting flexure of the shafts.

6. In a vibratory sieve construction in accordance with claim 5.

wherein said universal drive includes an axially extending projection and recess receiving the projection so that the shafts are yieldable in an axial direction.

7. In a vibratory sieve construction in accordance with claim 1:

wherein said intermediate wall is located halfway between said first and second walls.

8. The method of screening material such as ore or coal, comprising:

depositing the material on a substantially horizontal vibrating sieve member;

supporting the sieve member by first and second longitudinal sidewalls and applying an equal vibrational force to each of the sidewalls;

and supporting the sieve by an intermediate longitudinal wall between the sidewall and applying a second vibrational force to the intermediate wall twice the amount applied to each of the sidewalls with the second force being directly synchronized with the sidewall forces.

9. The method of screening material such as ore or coal comprising the steps of claim 8:

wherein the vibrational forces are applied by rotating eccentric weights and the weights for the drive for the intermediate walls are twice the mass of the weights for the sidewalls.

10. The method of secreening material such as ore or coal comprising the steps of claim 9:

wherein the weights are driven in rotation by shafts interconnecting each of the sidewall drives with the intermediate wall drive and each of the shafts have means for permitting axial flexibility.

11. In a vibratory sieve construction, the combination comprising:

a horizontal sieve member for receiving material on its upper surface to be screened;

first and second longitudinal sidewalls extending along the sieve member located adjacent the sides of an area of the sieve member with the walls in vibration transmitting support relative to the sieve member;

at least one intermediate longitudinal wall between said sidewalls in vibration transmitting support relation to the sieve member;

first and second vibratory drives connected to the sidewalls having a vibratory force output for applying said force to the sidewalls;

an intermediate vibratory drive connected to each of the intermediate walls each having a vibratory force output greater than the force output of each of said first and second drives;

means for interconnecting said first and second drives with said intermediate drive for operation in synchronism;

and motor means for applying an operating force to said drives.

* * * * *